United States Patent [19]

McDonnell

[11] Patent Number: 4,972,760

[45] Date of Patent: Nov. 27, 1990

[54] ADJUSTABLE AUTOMATIC FIREARM RECOIL SYSTEM

[76] Inventor: James F. McDonnell, 193 Harvard La., Seal Beach, Calif. 90740

[21] Appl. No.: 408,995

[22] Filed: Sep. 18, 1989

[51] Int. Cl.[5] ..... F41A 3/80

[52] U.S. Cl. ..... 89/196

[58] Field of Search ..... 89/129.01, 163, 178, 89/196

[56] References Cited

U.S. PATENT DOCUMENTS

| | | | |
|---|---|---|---|
| 1,200,685 | 10/1916 | Young | 89/196 |
| 1,311,715 | 7/1919 | Rosebush | 89/196 |
| 4,201,113 | 5/1980 | Seecamp | 89/163 |

*Primary Examiner*—Stephen C. Bentley
*Attorney, Agent, or Firm*—Charles H. Thomas

[57] ABSTRACT

An adjustable recoil system is provided for an automatic firearm, such as a .45 caliber Colt automatic pistol, in which expanding gas from a discharged round propels a slide rearwardly on the pistol frame to eject a spent shell. The adjustable recoil apparatus is comprised of first and second recoil springs axially aligned with each other and compressed between the slide and the frame. The compressed recoil springs have different spring constants and are disposed coaxially about an elongated recoil spring guide that extends parallel to the pistol barrel. An annular recoil spring retainer is coupled to the recoil spring guide in coaxial disposition thereabout and is interposed between the first and second recoil springs. An adjustment screw is threadably engaged in the recoil spring guide and is coupled to the recoil spring retainer to adjust the longitudinal position of the spring retainer relative to the spring guide to vary the relative degree of compression of the first and second recoil springs. The threaded adjustment screw is actuated from the exterior of the pistol frame.

15 Claims, 2 Drawing Sheets

ADJUSTABLE AUTOMATIC FIREARM RECOIL SYSTEM

BACKGROUND OF THE INVENTION

1. Field of the Invention

The present invention is directed to an adjustable recoil apparatus for an automatic firearm.

2. Description of the Prior Art

In an automatic firearm, such as an automatic pistol, a round within a firing chamber is detonated by impact from a firing pin. The explosion of the detonated charge produces a rapidly expanding volume of gas. The expanding gas propels a bullet from the round longitudinally through the barrel of the weapon. In addition, the expanding gas produces a force which propels the slide of the weapon located atop the pistol frame rearwardly relative to the frame. As the slide moves rearwardly an ejection finger or ramp ejects the spent shell from the firearm through the breech. In addition to effectuating ejection of the shell, the rearward movement of the slide cocks and feeds the next round to be fired into the slide. Successive rounds are typically provided from a magazine which, in the case of an automatic pistol, is normally located in the handle of the pistol frame.

A recoil spring system is provided in an automatic firearm to return the slide forwardly along the pistol frame to position the next successive round in the firing chamber and to latch the slide relative to the frame. In conventional automatic firearms, such as automatic pistols, there is a single recoil spring located in the frame beneath the barrel. However, for some ammunition loads the recoil spring may provide too great a recoil force, and for other ammunition loads the force may be too light. If the recoil force is too great for the ammunition load the slide will not be fully propelled to the rear of the firearm frame. When this occurs the firearm will fail to eject the shell. On the other hand, if the recoil spring system is too light for the ammunition load there is an excessive amount of shock or "kick" within the firearm. This impairs the ability to accurately aim successive rounds during rapid firing.

Currently, in competition shooting a competitor will typically have at hand several alternative springs which can be interchangeably installed in an automatic firearm to provide the appropriate force for the ammunition load being used. However, in order to change recoil springs in the firearm the recoil system must be substantially disassembled. This results in a delay in shooting and also an inconvenience in locating an appropriate spring among a competitor's equipment.

SUMMARY OF THE INVENTION

According to the present invention an automatic firearm is provided with an adjustable recoil system. That is, the recoil force of the recoil system can be adjusted from the exterior of the firearm without disassembling any portion of the firearm whatsoever. The adjustment can be performed rapidly and in a continuously variable fashion. Thus, the competitor is able to "fine tune" the recoil force in the firearm. This capability has heretofore been unattainable since competitors have previously been forced to choose from among springs having incremental differences in recoil force.

In one broad aspect the present invention is an improvement in a recoil system for an automatic firearm in which the gas produced from the discharge of a round of ammunition propels a slide rearwardly on a firearm frame to eject a shell and in which the slide is returned by the recoil spring system. The improvement of the invention is a recoil spring system that is adjustable to exert a selected recoil force on the slide.

In another broad aspect the invention may be considered to an adjustable recoil apparatus for an automatic firearm in which expanding gas from a discharged round propels a slide rearwardly on a firearm frame to eject a spent shell. The adjustable recoil apparatus is comprised of first and second recoil springs axially aligned with each other and compressed between the slide and the frame. The first and second recoil springs have different spring constants. A recoil spring guide is disposed coaxially within the coil springs and an annular recoil spring retainer is coupled to the recoil spring guide in coaxial disposition thereabout and is interposed between said first and second recoil springs. A means is provided for selectively adjusting the location of the recoil spring retainer longitudinally along the recoil spring guide.

The recoil spring guide of the adjustable recoil apparatus of the invention not only provides a laterally constraining guide to prevent radial movement of the recoil springs, but also serves as a means for structurally supporting the adjustment mechanism.

A primary object of the invention is to provide an adjustable recoil spring guide system for a firearm that allows the recoil spring force which returns the slide to battery relative to the firearm frame to be varied in accordance with the strength of the load of the ammunition being used. Furthermore, this adjustment is not limited to selection from among specific incremental recoil spring forces, but can be controlled in a continuously and infinitely adjustable manner.

The improved recoil spring system of the invention is particularly well suited for implementation in a .45 caliber Colt automatic pistol. In this firearm the firearm frame and the slide together define a recoil spring cavity. A recoil spring guide is provided in the form of an elongated rod that projects into the recoil spring cavity parallel to the direction of movement of the slide relative to the frame. A first compressed recoil spring having a first spring constant is disposed coaxially about the recoil spring guide within the recoil spring cavity to bear ultimately against the frame. A second compressed recoil spring having a second spring constant different from that of the first spring constant is disposed coaxially about the recoil spring guide. The second spring is also located with the recoil spring cavity and bears against the slide. An annular recoil spring retainer is disposed coaxially about the recoil spring guide in abutting contact with both the first and second recoil springs. A unique adjustment means is provided for securing the recoil spring retainer to the recoil spring guide at selected longitudinal positions therealong.

In a .45 caliber Colt automatic pistol the recoil spring force is preferably adjustable between five pounds and twenty two pounds. A recoil force of twenty two pounds is preferable for major .45 caliber loads while a recoil force of no less than twelve pounds is preferable for most .45 caliber light loads. This range of adjustment can be provided by employing a first recoil spring having a spring constant of twelve pounds per inch of compression and a second recoil spring having a spring constant of ten pounds per inch of compression. The first recoil spring is located rearwardly in the recoil spring cavity remote from the muzzle of the firearm while the second recoil spring is located forwardly adjacent to the muzzle.

The annular recoil spring retainer is located between the first and second springs and can be selectively positioned along the recoil spring guide to vary the relative extent of initial compression of the first and second recoil springs. That is, if the annular recoil spring retainer is positioned rearwardly along the recoil spring guide to more fully compress the heavier first rear spring prior to firing, the expanding gas from the discharge of a round of ammunition will result primarily in the compression of the lighter second, front spring. Thus, the return of the slide to its firing position is more greatly affected by the lighter recoil force provided by the second spring. A lighter recoil force is thereby achieved.

Conversely, if a heavier recoil force is desired, the annular recoil spring retainer is advanced forwardly along the recoil spring guide to more fully compress the lighter spring while in an initial firing position and to allow the heavier spring to be extended prior to firing. Thus, upon firing of a round, the return force of the recoil spring system is controlled to a greater extent by the first rear recoil spring as it is compressed rather than the second, front recoil spring. Such an adjustment can be performed to accommodate heavier loads of ammunition.

By utilizing a first rear twelve pound spring and a second, front ten pound spring an adjustment of the recoil force in a .45 caliber Colt automatic pistol can be varied from between a total of twenty two pounds down to twelve pounds. If desired, alternative interchangeable front springs can be provided to achieve lighter recoil return forces from twelve pounds down to five pounds.

While the invention has been developed for use with .45 caliber Colt automatic pistols, it is applicable to all types of automatic and semi-automatic weapons in which a slide is propelled rearwardly on a firearm frame and returned to the firing position automatically. The system of the invention can be employed in automatic rifles, as well as automatic pistols.

Adjustment of the recoil force is performed from the exterior of the frame of the firearm. Adjustment can be performed with an allen head wrench, with a worm adjustment, or in various other ways.

In a preferred embodiment of the invention a pair of springs are provided in axial alignment with each other on a hollow guide rod. The guide rod is internally threaded to receive a solid, externally threaded adjustment screw. The inwardly directed end of the adjustment screw bears against a transverse pin that is permanently secured to extend across the circular opening defined within an annular recoil spring retainer.

The recoil spring retainer encircles the guide rod. The guide rod has a pair of longitudinally extending, diametrically opposed, elongated slots which receive the transverse pin and allow the annular recoil spring retainer to be moved reciprocally along the guide rod between the limits defined by the ends of the slots. The recoil spring retainer is pressed forwardly by the rear recoil spring to the extent allowed by the longitudinal position of the adjustment screw, which is threadably engaged within the guide rod. The adjustment screw thereby limits the extent of compression and extension of the rear recoil spring, thereby varying the effective recoil force which returns the slide to its forward position and loads the chamber with the next cartridge following the firing of a bullet and expansion of gas within the firing chamber.

This embodiment of the invention can be adjusted by means of an allen head key having a handle and a tip which fits into an allen head socket defined in the forwardly directed face of the adjustment screw. The adjustment screw can thereby be advanced or withdrawn along the length of the guide rod without any disassembly of the recoil spring assembly. The user can thereby quickly and easily adjust the force of the recoil spring system in an infinitely variable manner using a simple allen head adjustment tool in order to provide the appropriate recoil force for a selected cartridge load.

The invention may be described with greater clarity and particularity with reference to the accompanying drawings

DESCRIPTION OF THE EMBODIMENTS

Figure 1:
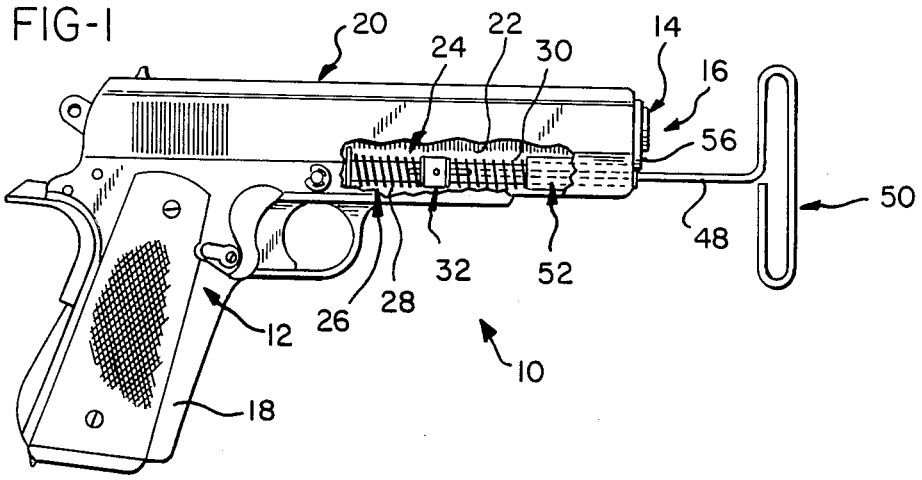
FIG. 1 is an elevational view, partially broken away, of an automatic firearm employing the adjustable recoil system of the invention.

FIG. 1 illustrates an automatic firearm 10, which is a .45 caliber Colt automatic pistol. The firearm 10 is comprised of a firearm frame 12 having the conventional firing chamber at the rear end of a barrel 14. In the drawings reference to front refers to the forward end of the firearm 10 at the muzzle 16 thereof, while rear refers to the direction proceeding toward the handle grip 18 of the frame 12.

Figure 3:
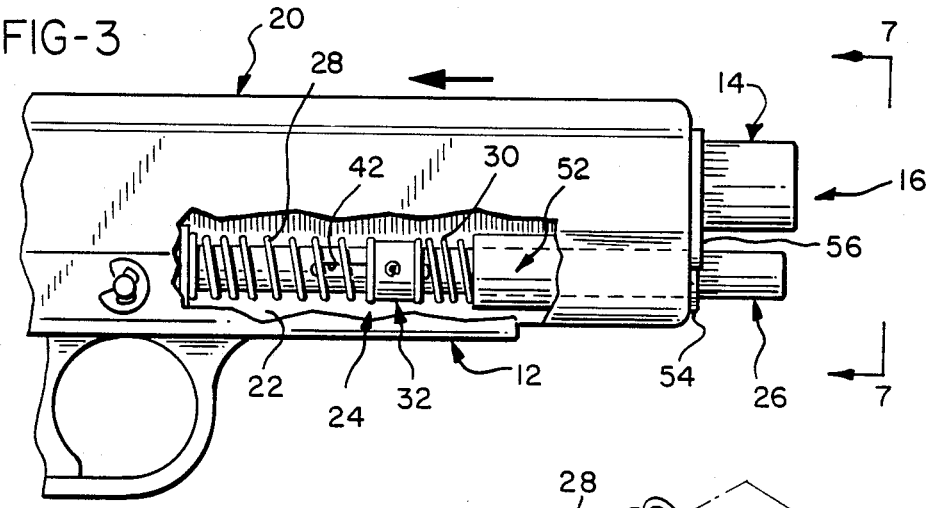
FIG. 3 is an enlarged view of the portion of the firearm of FIG. 2 during discharge of a round.
Figure 2:
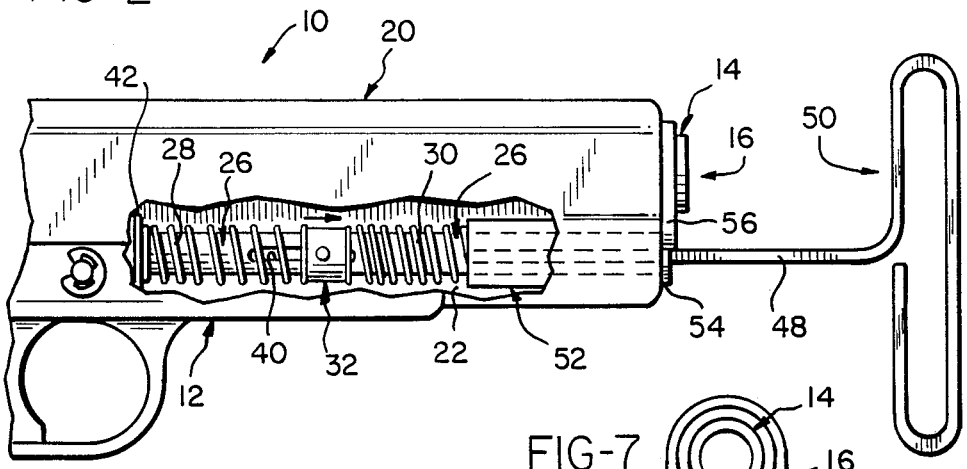
FIG. 2 is an enlarged elevational view of a portion of the firearm of FIG. 1 showing the recoil system in one alternative position of adjustment prior to firing.

The firearm 10, like conventional .45 caliber Colt automatic pistols, has a slide 20 that is mounted for reciprocal movement on the frame 12 parallel to the alignment of the pistol barrel 14. As illustrated in Figs. 1, 2 and 3 the frame 12 and slide 20 together define a recoil spring cavity 22 in which the adjustable recoil apparatus 24 of the invention is housed.

The adjustable recoil apparatus 24 includes a recoil spring guide 26 that projects into the recoil spring cavity 22 and is oriented parallel to the barrel 14 and to the direction of movement of the slide 20 relative to the frame 12. The adjustable recoil system 24 also includes a first compressed recoil spring 28 located at the rear of the recoil spring cavity 22 and having a first spring constant of twelve pounds per linear inch of compression. The first, rear recoil spring 28 is disposed coaxially about the recoil spring guide 26 within the recoil spring cavity 22 to bear against the frame 12 A second forward compressed recoil spring 30 is provided having a spring constant that is different from that of the spring constant of the spring 28.

As illustrated in FIGS. 1, 2 and 3, the first spring 28 is located rearwardly from the second spring 30 beneath the barrel 14 of the pistol 12. The second spring 30 has a spring constant of ten pounds per linear inch of compression. The recoil spring 30 is disposed coaxially about the recoil spring guide 26 within the recoil spring cavity 22 to bear against the slide 20. An annular recoil spring retainer 32 is disposed coaxially about the recoil spring guide 26 and in abutting contact with both the first and second recoil springs 28 and 30. A means is provided for securing the recoil spring retainer 32 to the recoil spring guide 26 at alternative selected longitudinal positions therealong in an infinitely variable manner.

The first spring 28 has a greater spring constant than the second spring 30. The first, heavier spring 28 is located rearwardly in the firearm 10 remote from the muzzle 16. The second and lighter spring 30 is located forwardly in the firearm 10 adjacent to the muzzle 16.

Figure 4:
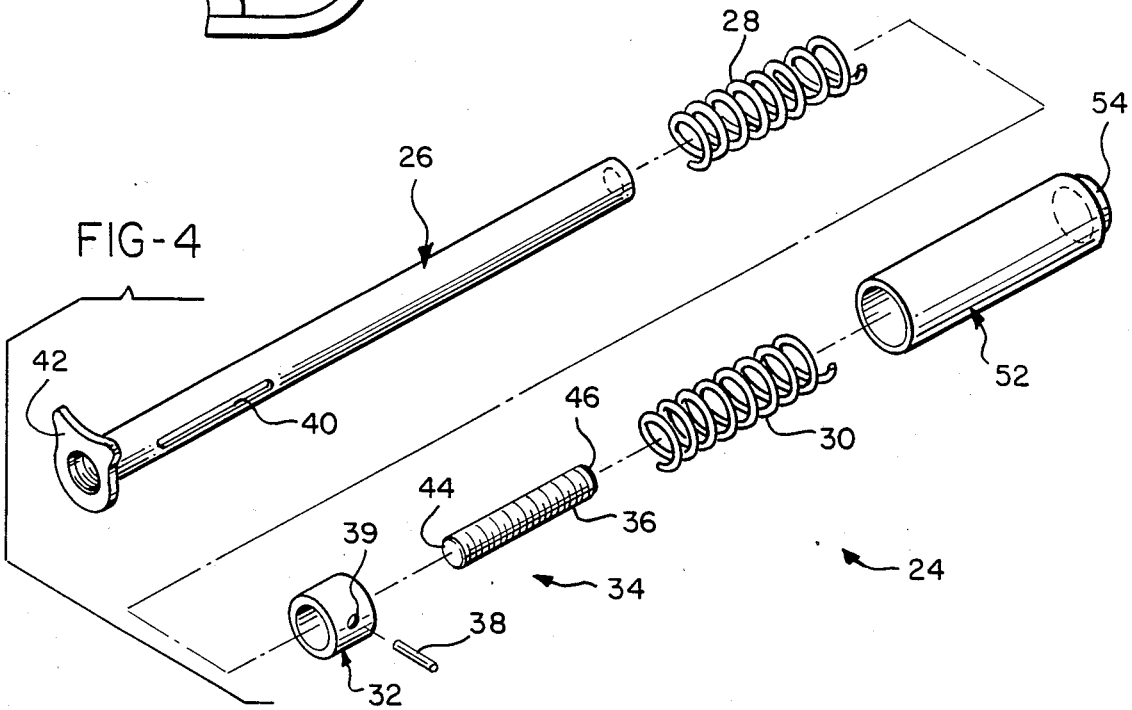
FIG. 4 is an exploded perspective view illustrating the recoil system employed in the firearm of FIG. 1.
Figure 5:
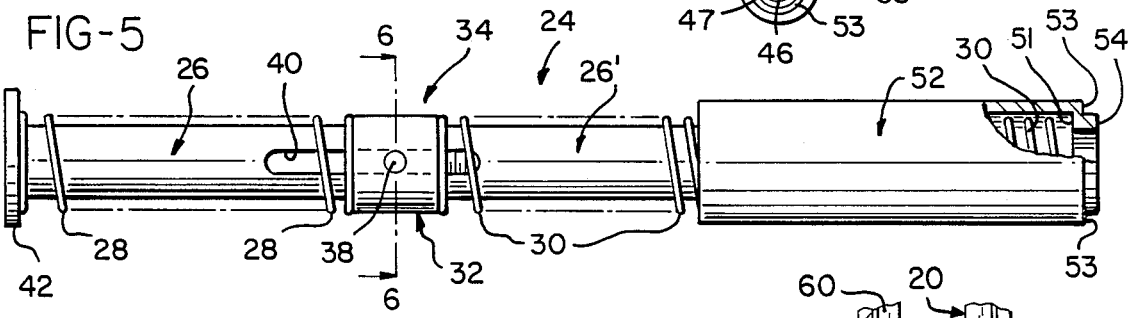
FIG. 5 is an enlarged side elevational view partially broken away, of the assembled recoil system employed in the firearm of FIG. 1 in isolation therefrom.

The means for securing the recoil spring retainer 32 to the recoil spring guide 26 is comprised of a spring compression adjustment means, indicated generally at 34 in FIGS. 4 and 5. The spring compression adjustment means 34 is comprised of an externally threaded adjustment screw 36, a transverse coupling pin 38, and a pair of diametrically opposed slots 40 which are closed at both ends and which are defined through the cylindrical annular wall of the recoil spring guide 26.

The recoil spring guide 26 is a guide rod that is of an internally threaded tubular configuration. The slots 40 defined in the wall of the spring guide 26 are both approximately seven eighths of an inch in length. The closed, rear ends of the elongated slots 40 lie approximately one quarter of an inch from a transverse bearing foot 42 at the rear end of the recoil spring guide 26. The bearing foot 42 bears rearwardly against a downwardly depending flange (not depicted) that is attached to the pistol barrel 14. The bearing foot 42 is thereby anchored in abutting relationship relative to the barrel 14, which in turn is anchored to the pistol frame 12. The rear end of the rear spring 28 thereby bears indirectly against the frame 12 of the pistol 10. The recoil spring guide 26 is thereby immovably mounted relative to the pistol frame 12 and extends parallel to the pistol barrel 14.

Figure 7:
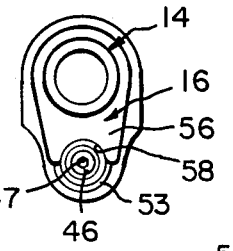
FIG. 7 is a transverse end elevational view taken along the lines 7—7 of FIG. 3.
Figure 6:
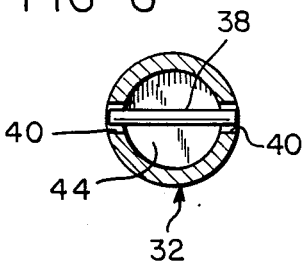
FIG. 6 is a transverse sectional view taken along the lines 6—6 of FIG. 5.

The transverse coupling pin 38 is a roll pin that extends through diametrically opposed circular openings 39 in the wall of the annular recoil spring retainer 32 and through the elongated slots 40 in the recoil spring guide 26. The externally threaded adjustment screw 36 is threadably engaged in the internal threaded recoil spring guide 26. The rear end 44 of the adjustment screw 36 resides in abutment against the transverse coupling pin 38, as illustrated in FIG. 6. At the opposite end 46 of the threaded adjustment screw 36 a hexagonal socket 47 is defined, as illustrated in FIG. 7, to receive the tip of the shank 48 of an allen head key 50. As illustrated in FIGS. 1 and 2 the threaded adjustment screw 36 is thereby accessible for advancement and withdrawal externally from the frame 12 of the automatic pistol 10.

The annular recoil spring retainer 32 is arranged coaxially about the recoil spring guide 26 and has an internal diameter large enough to allow it to move freely along the outer cylindrical surface of the recoil spring guide 26. As illustrated in FIGS. 1, 2 and 3, the recoil spring retainer 32 is disposed in abutting contact with both of the first and second recoil springs 28 and 30. As illustrated in FIG. 5 the annular recoil spring retainer 32 is constrained in longitudinal movement along the recoil spring guide 26 by the limit stops imposed by the forward and rearward ends of the elongated slots 40.

At the front of the pistol 10 the adjustable recoil system of the invention is provided with a tubular sleeve-like front spring retainer 52 which is disposed coaxially about the recoil spring guide 26. The front spring retainer 52 includes a transverse, internal bearing ledge 51 against which the second, forward spring 30 seats. The internal bearing ledge 51 provides a rearwardly facing annular surface within the front spring retainer 52 which is formed by a stepped down section 54 at the front of the front spring retainer 52. The diameter of the internal cylindrical opening within the front spring retainer 52 is reduced at the stepped down section 54 to allow passage of the recoil spring guide 26, but to confine the forward end of the second recoil spring 30 within the slide 20. The front spring retainer 52 thereby provides a rearwardly facing seat against which the forward end of the second compressed recoil spring 30 bears.

In the embodiment of FIGS. 1–8, the automatic pistol 10 is provided with an oblong latch 56 which is mounted on the slide 20 at the muzzle 16 of the firearm 10 for rotation relative thereto about the axis of the barrel 14. The latch 56 is formed with an arm that can be moved in rotation about the axis of the barrel 14 and which includes a radially outwardly directed concave seating surface 58.

The surface 58 is configured in an arc which conforms to the curvature of the necked down forward end 54 of the annular front spring retainer 52, as illustrated in FIG. 7. The reduced diameter end 54 of the annular front spring retainer 52 thereby resides in radial alignment with the latch 56. However, the rearwardly facing side of the latch 56 bears in interfering abutment against the outer end wall 53 of the front spring retainer 52. The releasable latch 56 is movable into interfering longitudinal alignment with the front spring retainer 52 to form a limit of forward movement of the front spring retainer 52 relative to the slide 20 to confine the front spring retainer 52 within the recoil spring cavity 22.

In some cases it may be desirable to replace the forward spring 30 with a lighter spring. To do this the bearing foot 42 is first unseated relative to the pistol barrel 14, in a conventional manner, to allow the recoil spring guide 26 to be moved slightly to the rear. The front spring retainer 52 is then depressed rearwardly into the recoil spring cavity 22 and the latch 56 is then rotated in either direction so that it no longer resides in interfering abutment against the end wall 53 of the front spring retainer 52. The front spring retainer 52 and the forward spring 30 can then be withdrawn out from the muzzle 16 of the firearm 10 toward the right, as viewed in FIG. 3. The forward spring 30 can then be replaced with a lighter spring, if desired.

The front spring retainer 52 is then reinserted and depressed into the recoil spring cavity 22 while the latch 56 is then rotated about its axis on the slide 20 until it is brought into radial alignment once again with the front spring retainer 52. The arm of the latch 56 will thereupon again bear against the front end wall 53 of the front spring retainer 52 to confine the adjustable recoil apparatus of the invention within the recoil spring chamber 22. The latch 56 thereby serves as a means for limiting forward movement of the front spring retainer 52 relative to the slide 14.

The front spring retainer 52 is entrapped between the front spring 30 and the slide 20 and moves with the slide 20 to compress the springs 28 and 30 during recoil. Since the latch 56 constrains forward movement of the front spring retainer 52, the front spring retainer 52 is releasably immobilized relative to the slide 20 in longitudinal abutment thereagainst. The front spring retainer 52 is adapted to receive and seat the forward, second spring 30. The front spring retainer 52 holds both of the recoil springs 28 and 30 compressed between the slide 20 and the firing arm frame 12.

To adjust the force of recoil for loads of ammunition of different strengths, the allen head key 50 is inserted into the central opening defined through the front spring retainer 52. The tip of the shank 48 of the allen head key 50 is engaged in the hexagonal socket 47 defined in the forward end 46 of the threaded adjustment 36. When the engaged allen head key 50 is turned counter-clockwise, the threaded adjustment screw 36 is retracted forwardly within the recoil spring guide 26. Since the spring constant of the first rear spring 22 is greater than that of the second forward spring 30, the rear spring 28 will carry the annular recoil spring retainer 32 forwardly, as indicated by the directional arrow in FIG. 2. Movement of the annular recoil spring retainer 32 in this direction serves to relieve an initial compression in the heavier coil spring 28 and allows the heavier recoil spring 28 to be extended to a greater extent. The forward ends of the slots 40 limit the extent of adjustment in this direction.

When the pistol 10 is fired with the annular recoil spring retainer 32 disposed in a forward position, as depicted in FIG. 3, the rearward movement of the slide 20 indicated by the directional arrow in FIG. 3, will be resisted by both the heavier recoil spring 28 and the lighter recoil spring 30. As a consequence, the automatic pistol 10 will be adjusted to provide a heavy recoil force suitable for heavier loads of ammunition.

Conversely, when it is desired to lighten the recoil force, the allen head key 50 is engaged in the socket 47 of the threaded adjustment screw 36 and turned clockwise to advance the threaded adjustment screw 36 rearwardly within the recoil spring guide 26. Such a state of adjustment is depicted, for example, in FIG. 1.

By applying an initial compression to the heavier, rear coil spring 28, the rear coil spring 28 can be moved to a position at which it is nearly or totally compressed by the threaded adjustment screw 36 acting through the annular recoil spring retainer 32. Thus, when the pistol 10 is fired the force of the expansion gas is resisted only by the lighter force of the second, front recoil spring 30. Such an adjustment is suitable for lighter loads of ammunition.

The allen head key 50 serves as a device which may be manipulated externally of the frame of the pistol 10 to adjust the longitudinal position of the recoil spring retainer 32 along the recoil spring guide 26. The threaded adjustment screw 36, together with the roll pin 38, are coupled to the recoil spring retainer 32 for adjusting the longitudinal position of the recoil spring retainer 32 along the recoil spring guide 26. This allows a user to vary the relative degree of compression of the first and second recoil springs 28 and 30. The allen head key 50 may be actuated and manipulated to any extent to selectively adjust the location of the recoil spring retainer 32 longitudinally along the recoil spring guide 26 in an infinitely adjustable manner.

As previously noted, in the embodiment of FIG. 1 the front spring retainer 52 is confined within the recoil spring housing 22 by the rotatable latch 56. The latch 56 is selectively rotatable into interfering alignment with the end wall 53 of the front spring retainer 52 to limit forward movement of the 52. The latch 56 is alternatively rotatable out of interfering alignment with the front spring retainer 52 to permit withdrawal of the front spring retainer 52 from the muzzle 52 of the firearm 10.

Figure 9:
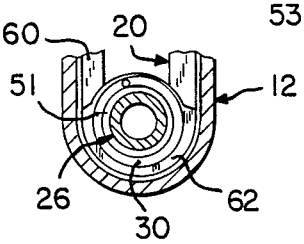
FIG. 9 is a transverse sectional view taken along the lines 9—9 of FIG. 8.
Figure 8:
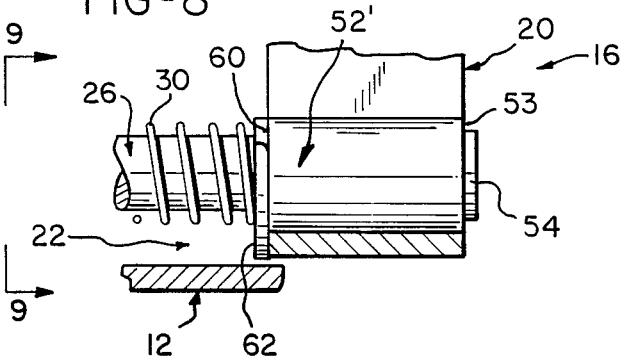
FIG. 8 is sectional elevational detail illustrating an alternative embodiment of the recoil system of the invention.

FIGS. 8 and 9 illustrate an alternative type of front spring retainer 52'. The front spring retainer 52' is of a cylindrical annular configuration throughout, with the exception of an arcuate, radially outwardly extending lip 62. The lip 62 resides in interfering alignment with a bearing ledge 60 on the slide 20. The bearing ledge 60 is located just forward from the lip 62. The lip 62 thereby resides in interfering alignment with the bearing ledge 60 so that the front spring retainer 52' is limited in forward movement relative to the slide 20, and is held against the ledge 60 by means of the compressed coil springs 28 and 30.

The front spring retainer 52', like the front spring retainer 52, defines a forward radially inwardly directed annular bearing ledge 51 against which the forward end of the forward spring 30 bears. The compressed springs 28 and 30 thereby hold the front spring retainer 52' in abutment against the bearing ledge 60 on the slide 20.

To install an adjustable recoil apparatus employing the front spring retainer 52' it is necessary to disassemble the slide 20 from the pistol frame 12 in the conventional manner. However, once the adjustable recoil mechanism employing the front spring retainer 52' is installed with springs 28 and 30 therewithin, the system can be adjusted in the same manner as depicted and described in association with the embodiment of FIGS. 1–7.

Undoubtedly, numerous variations and modifications of the invention will become readily apparent to those familiar with the construction of automatic weapons. Accordingly, the scope of the invention should not be construed as limited to the specific embodiments depicted and described, but rather is defined in the claims appended hereto.

I claim:

1. In a recoil system for an automatic firearm in which gas produced from the discharge of a round of ammunition propels a slide forwardly on a firearm frame to eject a shell and in which said slide is returned by a col spring system, the improvement wherein said recoil spring system is adjustable to exert a selected recoil force on said slide, and wherein said recoil system is comprised of a guide rod aligned parallel to the direction of movement of said slide on said frame, and first and second recoil springs having different spring constants arranged coaxially about said guide rod, an annular recoil spring retainer disposed in abutting contact with both of said recoil springs and coupled to said guide rod for selective longitudinal advancement relative thereto, and means coupled to said recoil spring retainer for adjusting the longitudinal position of said recoil spring retainer along said guide rod by actuation externally from said frame.

2. A recoil system according to claim 1 wherein said annular recoil spring retainer is disposed coaxially about said guide rod and is interposed between said first and second recoil springs, and wherein said guide rod is of an internally threaded tubular configuration and defines therein a pair of diametrically opposed slots which are closed at both ends, and further comprising a transverse coupling pin extending through said annular recoil spring retainer and through said elongated slots in said guide rod, and an externally threaded adjustment screw threadably engaged in said internally threaded guide rod and residing in abutment for advancement and withdrawal externally from said frame.

3. A recoil system according to claim 2 further characterized in that said automatic firearm is a .45 caliber pistol having a barrel through which said round of ammunition is discharged, and wherein said slide reciprocates on said frame and totally surrounds said barrel when in a battery position, and wherein said first spring is located rearwardly from said second spring beneath the barrel of said pistol, and said first spring has a spring constant of twelve pounds per inch and said second spring has a spring constant of ten pounds per inch, and said threaded adjustment screw is provided with an operating means located beneath said barrel.

4. A recoil system according to claim 3 further comprising an annular front spring retainer disposed coaxially about said guide rod and including a transverse internal bearing ledge against which said second spring seats, and means for limiting forward movement of said front spring retainer relative to said slide wherein said front spring retainer is entrapped between said front spring and said slide and moves with said slide to compress said springs during recoil.

5. A recoil system according to claim 4 further characterized in that said means for limiting forward movement of said front spring retainer is comprised of a latch rotatably mounted on the exterior of said slide and is selectively rotatable into interfering alignment with said front spring retainer to limit forward movement thereof and alternatively rotatable out of interfering alignment with said front spring retainer to permit withdrawal of said front spring retainer from said firearm.

6. A recoil system according to claim 4 further characterized in that said means for limiting forward movement of said front spring retainer is comprised of a radially outwardly extending lip on said front spring retainer that resides in longitudinal alignment with a bearing ledge on said slide which is located forward of said lip, whereby said springs hold said front spring retainer in abutment against said bearing ledge on said slide.

7. An adjustable recoil apparatus for an automatic firearm in which expanding gas from a discharged round propels a slide rearwardly on a firearm frame to eject a spent shell comprising: a first and a second recoil spring axially aligned with each other and compressed between said slide and said frame and wherein said first and second springs have different spring constants, a recoil spring guide disposed coaxially within said coil springs, an annular recoil spring retainer coupled to said recoil spring guide in coaxial disposition thereabout and interposed between said first and second recoil springs, and means for selectively adjusting the location of said recoil spring retainer longitudinally along said recoil spring guide.

8. An adjustable recoil apparatus according to claim 7 wherein said automatic firearm has a muzzle and said first spring is located rearwardly in said firearm remote from said muzzle and said second spring is located forwardly in said firearm adjacent to said muzzle and said first spring has a greater spring constant than said second spring.

9. An adjustable recoil apparatus according to claim 8 wherein said recoil spring guide is of tubular configuration and is interiorally threaded and said means for selectively adjusting the location of said recoil spring retainer is comprised of an externally threaded adjustment screw threadably engaged in said recoil spring guide and coupling means connecting said adjustment screw to said recoil spring retainer.

10. An adjustable recoil apparatus according to claim 9 further comprising a front spring retainer disposed coaxially about said recoil spring guide and releasably immobilized relative to said slide and located so as to receive said second spring therewithin and hold both of said springs compressed between said slide and said firearm frame.

11. An adjustable recoil apparatus according to claim 10 wherein said front spring retainer includes a radially projecting tang that resides in abutment against said slide to limit movement of said front spring toward said muzzle.

12. An adjustable recoil apparatus according to claim 10 wherein said slide is provided with a releasable latch that is selectively movable into interfering longitudinal alignment with said front spring retainer to form a limit of forward movement of said front spring retainer relative to said slide.

13. An automatic firearm comprising: a firearm frame having a barrel, a slide mounted for reciprocal movement on said frame whereby said frame and said slide together define a recoil spring cavity, a recoil spring guide projecting into said recoil spring cavity parallel to the direction of movement of said slide relative to said frame, a first compressed recoil spring having a first spring constant disposed coaxially about said recoil spring guide within said recoil spring cavity to bear against said frame, a second compressed recoil spring having a second spring constant different than that of said first spring constant and disposed coaxially about said recoil spring guide within said recoil spring cavity to bear against said slide, an annular recoil spring retainer disposed coaxially about said recoil spring guide in abutting contact with both said first and second recoil springs, and means for securing said recoil spring retainer to said recoil spring guide at selected longitudinal positions therealong.

14. An automatic firearm according to claim 13 wherein said means for securing said recoil spring retainer to said recoil spring guide is comprised of spring compression adjustment means threadably engaged with said recoil spring guide and coupled to said recoil spring retainer and actuable from the exterior of said firearm frame to adjust the longitudinal position of said recoil spring retainer along said guide to thereby vary the relative degree of compression of said first and second springs.

15. An automatic pistol according to claim 14 wherein said first spring has a greater spring constant than said second spring.

* * * * *